United States Patent [19]

Kusz

[11] 4,399,921

[45] Aug. 23, 1983

[54] CHILD RESISTANT CLOSURE AND CONTAINER

[75] Inventor: Maximillian Kusz, Waterville, Ohio

[73] Assignee: Owens-Illinois, Inc., Toledo, Ohio

[21] Appl. No.: 366,795

[22] Filed: Apr. 9, 1982

[51] Int. Cl.[3] ..... B65D 55/02

[52] U.S. Cl. ..... 215/218; 215/214; 215/221

[58] Field of Search ..... 215/211, 213, 214, 217, 215/218, 221

[56] References Cited

U.S. PATENT DOCUMENTS

| | | | |
|---|---|---|---|
| 3,828,958 | 8/1974 | Shannon | 215/221 |
| 3,858,741 | 1/1975 | Smith, Jr. | 215/218 |
| 4,061,239 | 12/1977 | Tasseron | 215/221 |

*Primary Examiner*—George T. Hall

*Attorney, Agent, or Firm*—John R. Nelson; Myron E. Click

[57] ABSTRACT

A child resistant closure and container comprising a container, a finish fitment rotatably mounted on the open end of the container, and a closure having a top wall and a skirt. Threads between the finish fitment and the skirt require relative rotation to disengage the closure from the finish fitment. The finish fitment includes a top portion interposed between the top wall of the closure and the container such that the top wall of the container engages the top portion of the finish fitment. The fitment and the closure are rotatable relative to said container and said threads are disengageable only when said fitment is manually grasped and prevented from rotating relative to the container. The container includes projections that engage notches in the fitment to prevent rotation of the fitment during threading of the closure so that the fitment need not be held manually during the application of the closure.

11 Claims, 9 Drawing Figures

CHILD RESISTANT CLOSURE AND CONTAINER

This invention relates to child resistant packages.

BACKGROUND AND SUMMARY OF THE INVENTION

It has been recognized that in connection with the packaging of drugs and similar products, it is desirable to provide child resistant packages that are not easily operable by children in order to insure their safety. One of the problems with many of the packages that have been proposed is that they are also difficult to manipulate by the elderly and persons suffering from arthritis and other diseases.

It has been suggested that a child resistant closure be provided that includes a container, a finish element or fitment on the container, and a closure wherein the fitment is rotatable relative to the container preventing the closure from being removed but can be manually grasped as by thumb pressure to permit the closure from being removed. Typical child resistant packages of this type are shown in U.S. Pat. Nos. 3,403,803, 3,426,931, 3,595,427, 3,656,646, 3,677,431 and 4,089,433.

One of the problems with such prior packages is that their design is such that the finish fitment cannot freely rotate so that they may not be as child resistant as might be desired. Another problem with such child resistant packages is that it is necessary to grasp the finish element both during application and removal of the closure.

Accordingly, among the objects of the present invention are to provide a child resistant package wherein the fitment is free to rotate when the closure is applied and tightened in position; wherein the child resistant package provides a fluid tight seal; wherein the closure is child resistant and yet can be operated by the elderly and disabled; and wherein the closure can be applied without the need to grasp any separate element other than the closure and container manually during application of the closure.

A child resistant closure and container comprising a container, a finish fitment rotatably mounted on the open end of the container, first interengaging means between the finish element and the container, and a closure having a top wall and a skirt. Interengaging means are provided between the finish element and the skirt requiring relative rotation to disengage the closure from the finish fitment. The finish fitment includes a top portion interposed between the top wall of the closure and the container such that the top wall of the container engages this portion of the fitment. The fitment and the closure is rotatable relative to the container and the interengaging means are disengageable only when said fitment is manually grasped and prevented from rotating relative to said container. The container and fitment have additional interengaging means operable to prevent rotation of the fitment only when the closure is being applied so that the fitment need not be held manually during application of the closure.

DESCRIPTION

Figure 1:
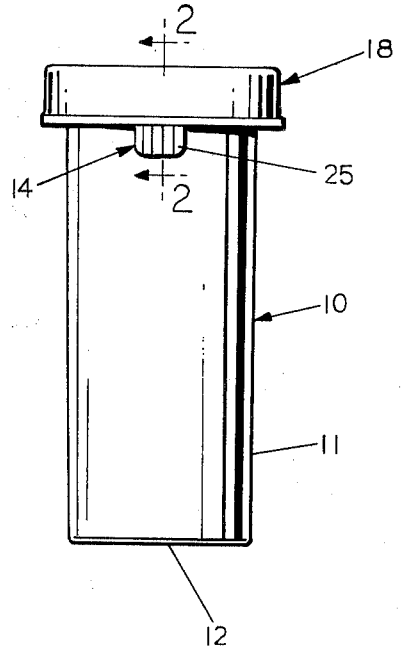
FIG. 1 is a fragmentary sectional view of a child resistant package embodying the invention.
Figure 2:
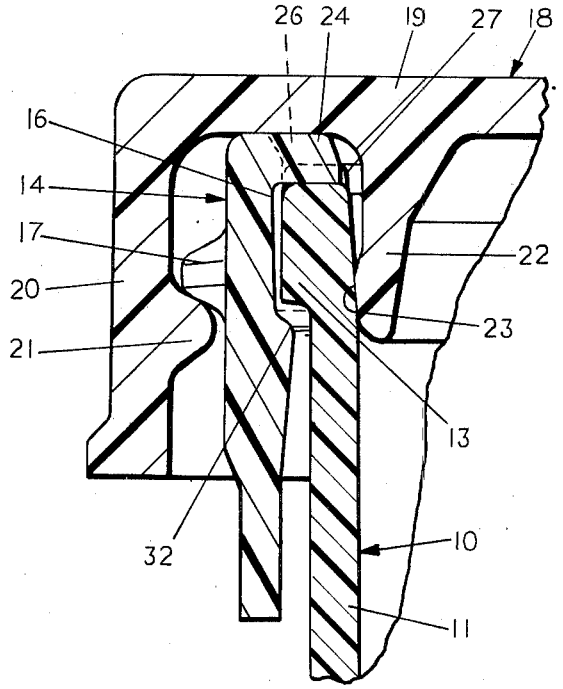
FIG. 2 is a fragmentary sectional view taken along the line 2—2 in FIG. 1.
Figure 3:
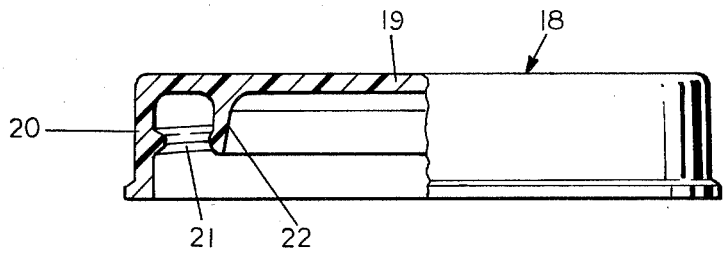
FIG. 3 is a part sectional elevational view of a closure of the child resistant package.
Figure 4:
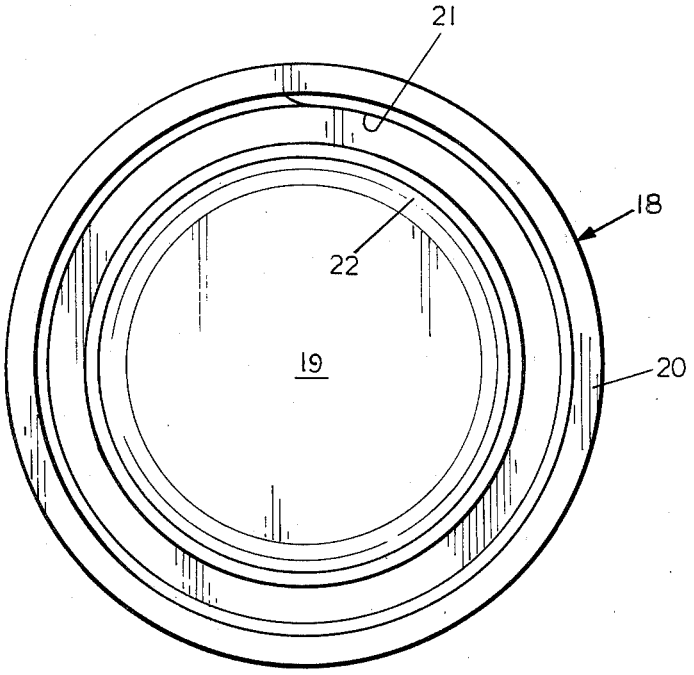
FIG. 4 is a bottom plan view of the closure.

Referring to FIGS. 1-9, the child resistant package embodying the invention comprises a container 10 having a cylindrical side wall 11, a bottom wall 12, and a peripheral flange or bead 13 at its open upper end. The package further includes a plastic finish element or fitment 14 that includes an annular wall 15 having an inner peripheral groove 16 on its inner surface into which the flange 13 of the container 10 extends (FIG. 2). The wall 14 includes an external thread 17 on its outer surface. The package further includes a closure 18 having a top wall 19 and a peripheral skirt 20 with an internal thread 21 adapted to engage the external thread 17 on the fitment 14 (FIG. 2). The top wall 19 includes an outwardly flared flexible skirt 22 that is adapted to extend into the open end of container 10 and the outer surface 23 thereof is adapted to engage the inner surface of the wall 11 of the container 10 to form a fluid tight seal (FIG. 2).

Figure 5:
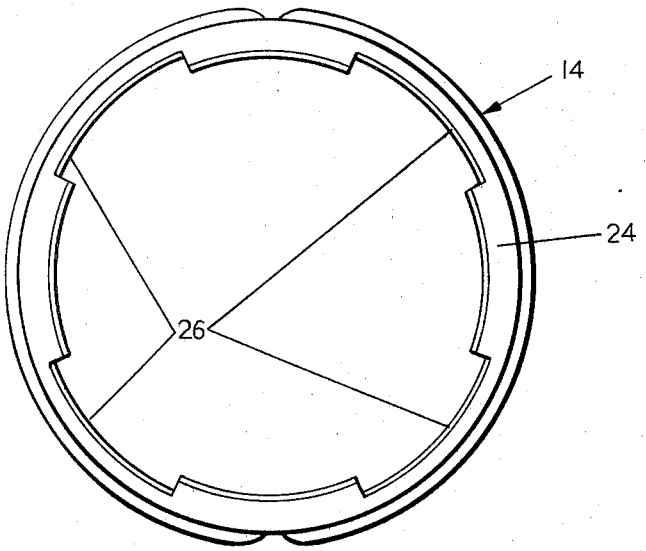
FIG. 5 is a top plan view of the finish fitment of the child resistant package.
Figure 6:
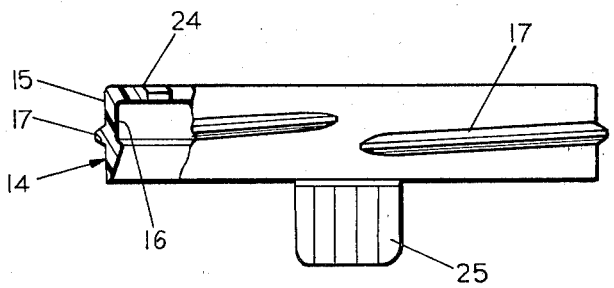
FIG. 6 is a part sectional elevational view of the finish fitment.

The finish fitment 14 also includes an integral flange 24 that extends radially inwardly into overlying relationship between the open end of container 10 and the undersurface of the top wall 19 of closure 18 (FIGS. 2, 5, 6). The fitment 14 further includes means for grasping the fitment to prevent its rotating, herein shown as a flexible tab 25 that is flexed by engagement of a thumb or finger into frictional engagement with the wall 11 of the container, as presently described (FIGS. 1, 2).

Fitment 14 further includes a plurality of circumferentially spaced notches 26 on the inner periphery of flange (FIGS. 5, 6).

Figure 7:
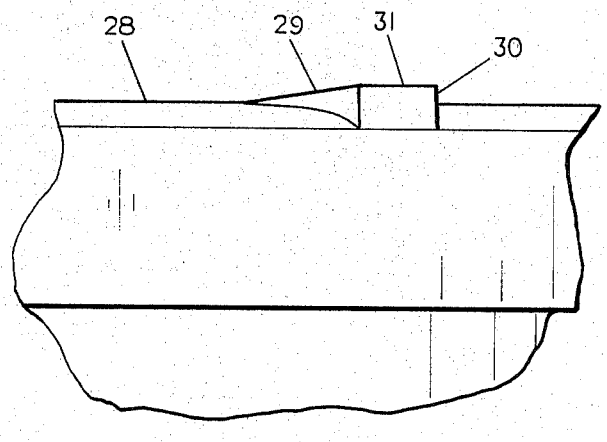
FIG. 7 is a fragmentary elevational view on an enlarged scale of a portion of the container.
Figure 9:
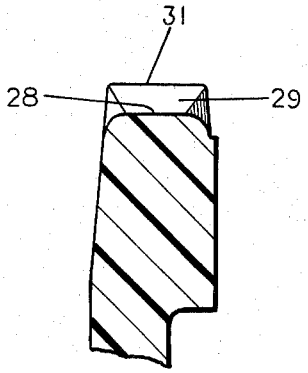
FIG. 9 is a fragmentary sectional view taken along the line 9—9 in FIG. 8.
Figure 8:
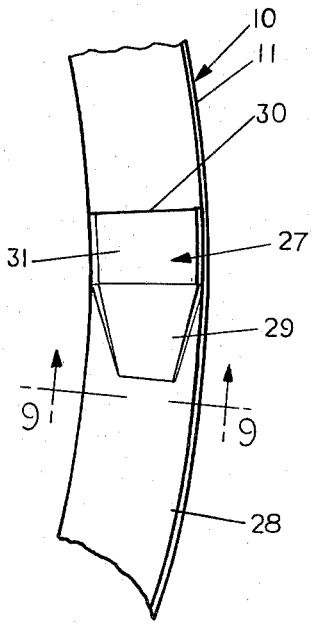
FIG. 8 is a fragmentary plan view on an enlarged scale of a portion of the container.

The container 10 has a plurality of projections 27 extending upwardly from the upper end 28 of the wall 11 thereof, the number of projections 27 corresponding to the number of notches 26. Each projection includes a ramp 29 forming a small angle with the top surface of end 28, an opposite surface 30 forming a 90° angle with the surface, and an intermediate flat surface 31 (FIGS. 7-9). The lower edge of groove 16 is defined by an annular retention bead 32. Groove 16 is slightly larger in diameter than flange 13 while retention bead 32 is slightly smaller in diameter than flange 13. The distance between retention bead 32 and the bottom of flange 24 on the fitment is slightly larger than the distance from the bottom of flange 13 to the top of projections 27 on the container.

The container 10 may be made of plastic or glass. A preferred material comprises polypropylene. Closure 18 is preferably made of a flexible plastic such as polyethylene. Fitment 14 is preferably made of a rigid plastic such as polypropylene.

Fitment 14 is applied to container 10 by snapping the fitment over the flange or bead 13. The fitment is now retained on the container by means of flange 24 and retaining bead 32. The closure 18 is then threaded on the fitment 14. This further strengthens the side wall of fitment 14 making it extremely difficult to remove the mated fitment and closure from the container by prying retention bead 32 over flange 13. During application closure 18 is rotated in one direction or clockwise the fitment 14 first rotates relative to the container 10 until the flange 24 of the fitment 14 rotates sufficiently to cause the projections 27 to extend into the notches 26. Thereafter, continued rotation of the closure 18 will cause the closure to be applied and tightened while the fitment 14 is prevented from rotation by the surfaces 30 engaging one end of the notches 26. As a result, the fitment 14 need not be prevented from rotation by grasping or applying pressure to tab 25 during closure application.

The closure 18 is rotated until the required degree of tightness is achieved. The flexible flange 22 on the closure 18 provides the desired moisture vapor seal with the inside surface of the container 10 as soon as the closure moves axially to bring surface 23 of flange 22 into contact with the inner surface of the container 10. If a moisture vapor seal is not required, the flange 22 can be omitted. The degree of tightness is controlled entirely between the inner surface top wall 19 of the closure 18 and the top of flange 24 and does not in any way affect the ability of the fitment 14 to rotate freely relative to the container 10. If the closure 18 is rotated in the opposite direction, the closure 18 and fitment 14 will rotate in unison so that the closure will not be removed. However, if the fitment 14 is grasped as by the finger tab 25, and held stationary relative to the container 10, the closure 18 can be removed by rotation in the opposite or counterclockwise direction.

I claim:

1. A child resistant closure and container comprising
a container,
a finish fitment rotatably mounted on the open end of the container,
first interengaging means between the finish fitment and the container permitting rotation of the fitment and container,
a closure having a top wall and a skirt,
second interengaging means between the finish fitment and the skirt requiring relative rotation to disengage the closure from the finish fitment,
said finish fitment including a top portion interposed between the top wall of the closure and the container such that the top wall of the container engages the portion of the fitment element,
said fitment element and said closure being rotatable relative to said container and said second interengaging means being disengageable only when said fitment element is manually grasped and prevented from rotating relative to said container,
and third interengaging means between the fitment and container such that relative rotation between the fitment and container is prevented during application of the closure,
and means for grasping the fitment to prevent rotation during removal of the closure.

2. The child resistant closure and container set forth in claim 1 wherein said first interengaging means comprises an annular flange on the upper end of the container and a groove in said finish element.

3. The child resistant closure and container set forth in claim 1 wherein said second interengaging means comprises interengaging threads between the periphery of the finish element and the skirt.

4. The child resistant closure and container set forth in claim 1 wherein said means for grasping the fitment to prevent rotation comprises a finger engaging tab projecting downwardly from said finish element which is operable upon being pressed by a finger to prevent relative rotation between the finish element and the container.

5. The child resistant closure and container set forth in claim 1 wherein said third interengaging means comprises upwardly extending projections on the upper end of the container.
said finish fitment including a radially inwardly extending flange having circumferentially spaced notches which are engaged by the projections when the closure is rotated to interengage said second interengaging means thereby preventing relative rotation between the fitment and the container during the application of the closure,
said projections being such that they are disengaged upon rotation of the closure in a direction to disengage said second interengaging means so that the finish fitment will rotate with the closure unless it is prevented from doing so by manual pressure.

6. A child resistant closure and container comprising
a plastic container,
a plastic finish fitment rotatably mounted on the open end of the container permitting relative rotation between said fitment and said container,
first interengaging means between the finish fitment and the container,
a plastic closure having a top wall and a skirt,
second interengaging means between the finish fitment and the skirt requiring relative rotation to disengage the closure from the finish fitment,
said finish fitment including a top portion interposed between the top wall of the closure and the container such that the top wall of the container engages the portion of the fitment element,
said fitment element and said closure being rotatable relative to said container and said second interengaging means being disengageable only when said fitment element is manually grasped and prevented from rotating relative to said container,
and third interengaging means between the fitment and container such that relative rotation between the fitment and container is prevented during application of the closure,
and means for grasping the fitment to prevent rotation during removal of the closure.

7. The child resistant closure and container set forth in claim 6 wherein said first interengaging means comprises an annular flange on the upper end of the container and a groove in said finish element.

8. The child resistant closure and container set forth in claim 6 wherein said second interengaging means comprises interengaging threads between the periphery of the finish element and the skirt.

9. The child resistant closure and container set forth in claim 6 wherein said means for grasping said fitment includes a finger engaging tab projecting downwardly from said finish element which is operable upon being pressed by a finger to prevent relative rotation between the finish element and the container.

10. The child resistant closure and container set forth in claim 6 wherein said third interengaging means comprises upwardly extending projections on the upper end of the container, said finish fitment including a radially inwardly extending flange having circumferentially spaced notches which are engaged by the projections when the closure is rotated to interengage said second interengaging means thereby preventing relative rotation between the fitment and the container during the application of the closure, said projections being such that they are disengaged upon rotation of the closure in a direction to disengage said second interengaging means so that the finish fitment will rotate with the closure unless it is prevented from doing so by manual pressure.

11. The child resistant closure and container set forth in claim 10 wherein said first interengaging means between the finish fitment and the container comprises an annular wall on said fitment, said wall having a peripheral groove on the inner surface thereof, said container having a peripheral flange extending into said groove, the lower edge of said groove being defined by a retention bead, the base of said groove having a slightly greater diameter than the periphery of the flange on the container, the retention bead having a diameter slightly smaller than the diameter of the flange on the container, the distance between the retention bead and the bottom of said flange on the finish fitment being slightly greater than the distance between the bottom of the flange on the container and the top of the projections on the container.

* * * * *